United States Patent [19]

Evin

[11] Patent Number: 4,789,050

[45] Date of Patent: Dec. 6, 1988

[54] CONTROL MEANS FOR AN ELECTRIC MOTOR

[75] Inventor: Jean Evin, Pont A Marcq, France

[73] Assignee: Sarl Logilift, Pont A Marcq, France

[21] Appl. No.: 824,118

[22] Filed: Jan. 30, 1986

[30] Foreign Application Priority Data

Feb. 12, 1985 [FR] France ..... 85 02381

[51] Int. Cl.[4] ..... B66B 1/16

[52] U.S. Cl. ..... 187/134

[58] Field of Search ..... 187/29 R, 134, 113; 318/309, 313, 616, 640, 653, 603; 340/19 R, 20

[56] References Cited

U.S. PATENT DOCUMENTS 3,227,884 1/1966 Rantsch et al. ..... 318/653 X 4,446,946 5/1984 Kajiyama et al. ..... 187/29 R

*Primary Examiner*—William M. Shoop, Jr.

*Assistant Examiner*—Richard K. Blum

*Attorney, Agent, or Firm*—Kerkam, Stowell, Kondracki & Clarke

[57] ABSTRACT

The invention provides a process for the regulated control of an electric motor more particularly for an elevator, goods lift or storage installation.

According to the method of the invention, along the path a coded strip (20) is disposed comprising evenly spaced marks which are read by a reader (23) fixed to the moving body.

Counting means (29) give the absolute position of the moving body and means (30) are provided for calculating its speed from counting of the marks.

These means are followed by the central processing unit (31) which sends to the motor a regulated voltage control.

9 Claims, 3 Drawing Sheets

Figure 2:
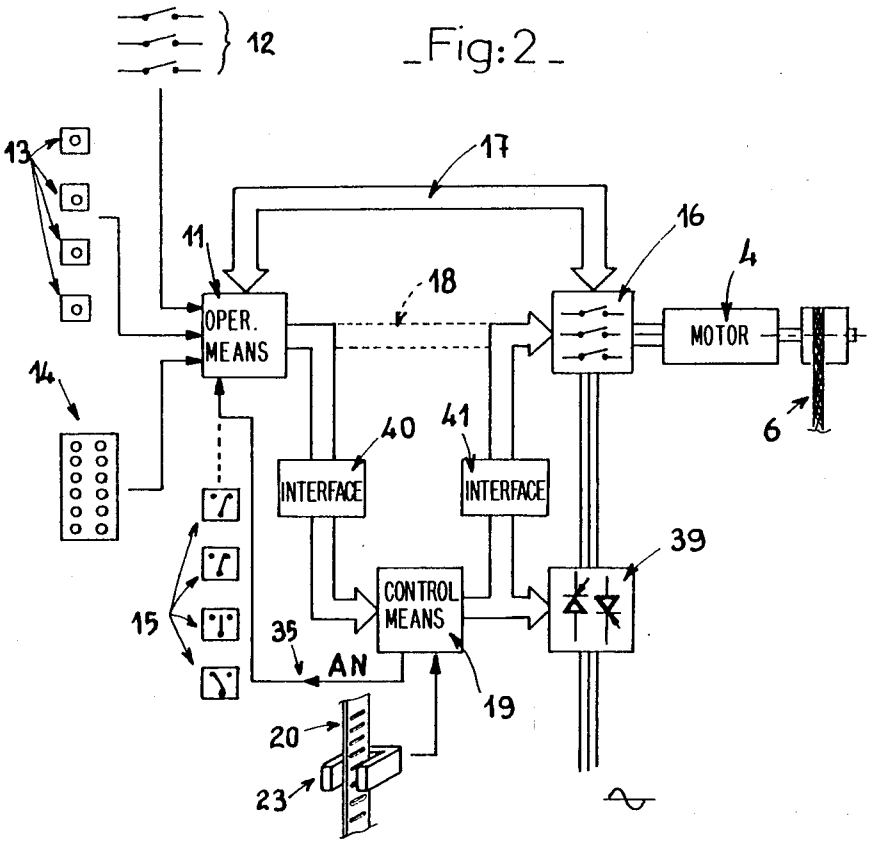

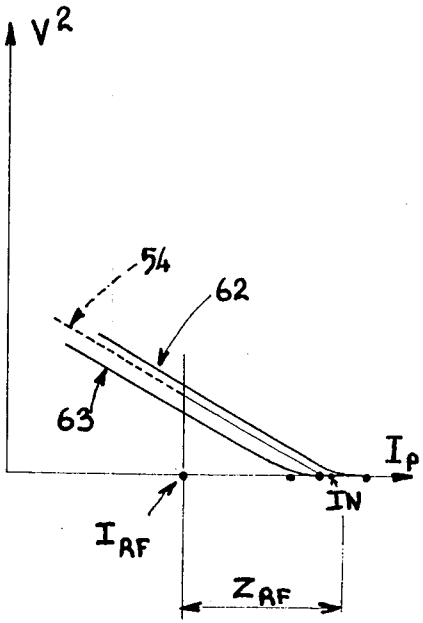
_Fig:5_
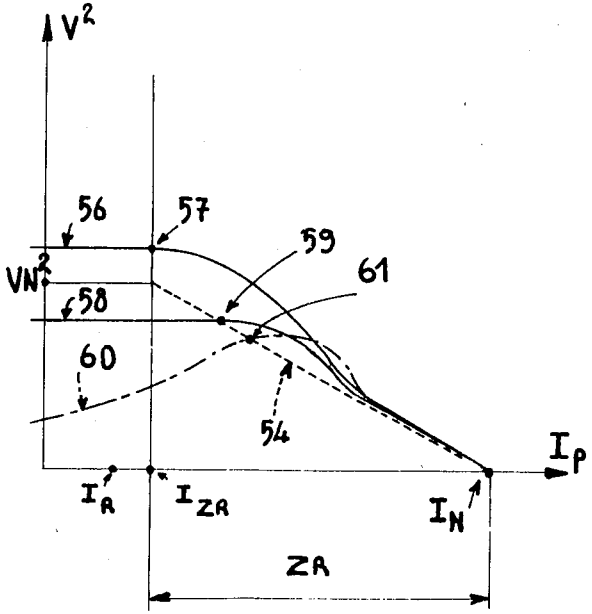
_Fig:6_
_Fig:7_

CONTROL MEANS FOR AN ELECTRIC MOTOR

The invention relates to a method for the regulated control of an electric motor for moving a body along the given path, comprising stopping levels and zones of movement between the levels.

The invention also relates to a device for the regulated control of an electric motor for implementing the method.

In particular, but not exclusively, the invention applies to the regulated control of an electric motor driving a goods lift, an elevator, a truck for a storage or handling installation.

More precisely, in the case of elevator installation, optimum comfort is at present sought for the users which requires a progressive acceleration and deceleration of the cabin, and a total absence of jolting.

This feeling of optimum comfort for a user is one of the aims of the present invention.

It is at the present time known to obtain progressiveness of the speed variations, at start up and when braking by means of an electronic regulation which drives the electric power supply of the motor.

This method of control forms a distinct improvement in the comfort level of users with respect to prior installations where the electric motor comprised one or two speeds and where at least a part of the braking was obtained by a friction device with therefore mechanical wear problems.

In so far as the electronic regulation of the motor is concerned, it may be applied to installations whose motor is fed with DC current more particularly of the Ward Leonard groups.

These installations, however, are characterized by their high cost and so can only be produced in limited numbers.

Other installations with an AC electric motor very often three phase, are provided with an electronic regulation for both improving the comfort of users and limiting the duration of mechanical braking and so reducing the problems of brake wear.

Such regulations, however, are complex to put into practice.

They generally require information about the position of the cabin which is very often given by sheathed contactors which the cabin actuates when passing.

They also require information about the speed of the cabin which is given by other means, for example by a tachometric generator or a coded disk mounted on the drive shaft.

In addition, with the electronic regulation units at present existing it is difficult to find the best compromise between the comfort of users, the progressiveness of the speed variations and optimization of the slowing down speed until the cabin comes to a stop, whatever the conditions of use of the cabin may be, that is to say whether this latter is overloaded or underloaded with respect to the counter weight.

One of the aims of the present invention is to provide a method for the regulated control of an electric motor for moving a body along a given path, more particularly an elevator, which overcomes these drawbacks and which provides perfect progressiveness of slowing down in an optimum time whatever the load conditions of the moving body.

Another aim of the present invention is to provide a method of regulated control which may be applied advantageously to already existing installations, with a minimum of transformation.

Another aim of the present invention is to provide a device for the regulated control of an electric motor which may advantageously be integrated in an already existing installation with a minimum of transformation.

Other aims and advantages of the present invention will be clear from the following description.

For this, it relates to a method for the regulated control of an electric motor for moving a body along a given path comprising stopping levels and zones of movement between the levels, along which path is disposed a coded means carrying evenly spaced marks which are detected by a reader and which can be used for deducing the speed of the moving body, this method being characterized in that:

along the coded means, at least one reference position of the moving body is defined with which there is associated a reference mark of the coded means, with each stopping level is associated a number of marks counted from the reference mark, which number is called level index.

for each level, from the corresponding level index, an interval of marks is defined corresponding to the slowing down zone of the moving body for reaching the level, during movement of the moving body, the number of marks met by the reader fixed to the moving body is counted algebraically and, by upcounting/downcounting the marks, the position index of the moving body is calculated with respect to the reference mark, for stopping the moving body at a defined level, within the interval of marks corresponding to the slowing down zone there is defined a speed/deviation reference between the position index and the level index and continuous electric braking of the motor in accordance with the slowing down reference is only provided from the mark of the slowing down zone for which the speed of the moving body is at least equal to the reference speed.

The device for the regulated control of the moving body comprises, disposed along the path of the moving body, a coded means which carries evenly spaced marks which are detected by a reader and which are used for deducing the moving speed thereof.

It is more particularly characterized by the fact that it comprises in combination:.

on the coded means, at least one reference mark corresponding to a reference position of the moving body, a reader fixed to the moving body for reading the marks of the coded means, means for the algebraic counting of the number of marks met by the reader during the movements of the moving body and by upcounting/downcounting the marks, means for calculating the position index of the moving body, processing means for sending to the electric motor a continuous progressive braking voltage order within an interval defined by marks corresponding to a slowing down zone, said order being determined from the difference between the position index of the motor and the level index and the difference between the speed of the moving body and the reference speed for the position index.

The invention will be better understood from the following description which, for facilitating understanding thereof, will refer to an application to the equipment of an existing elevator installation.

This application, naturally, is not limitative and such as will be clear from the description, the invention also applies to other types of installation and in particular to new elevator installations.

Figure 1:
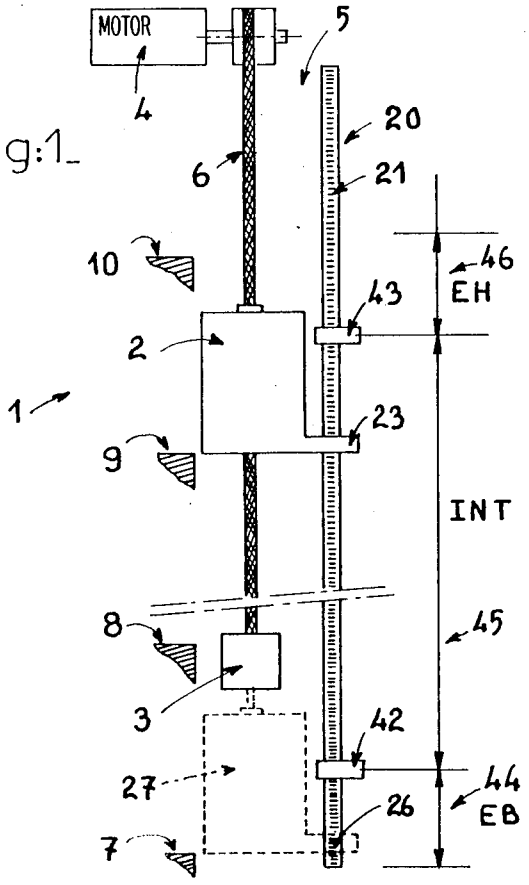
Figure 4:
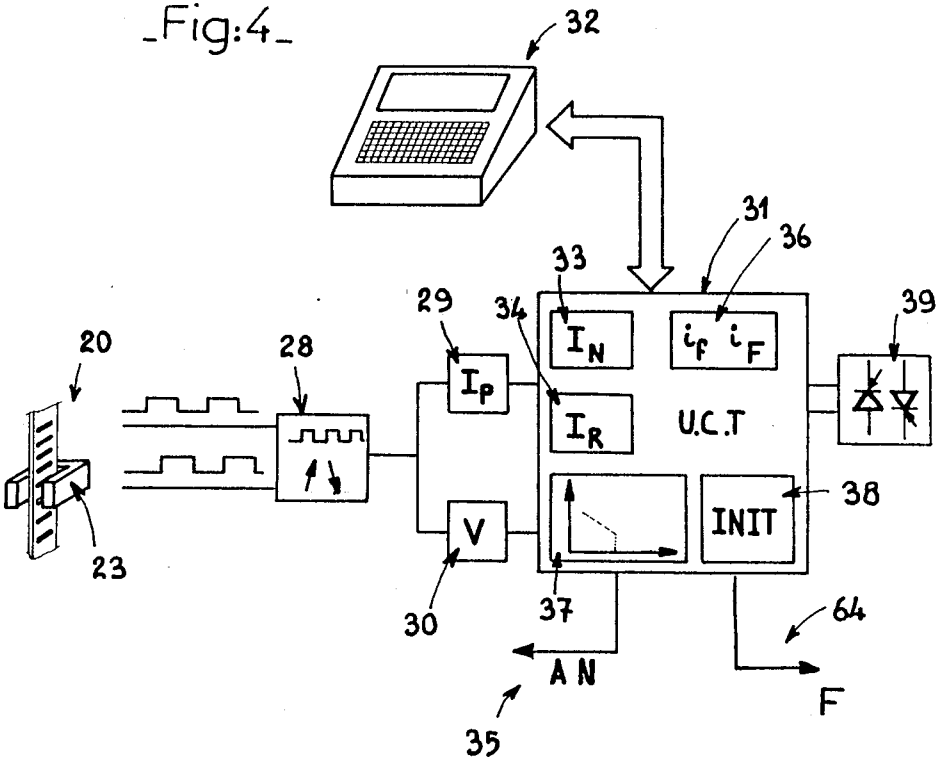
Figure 3:
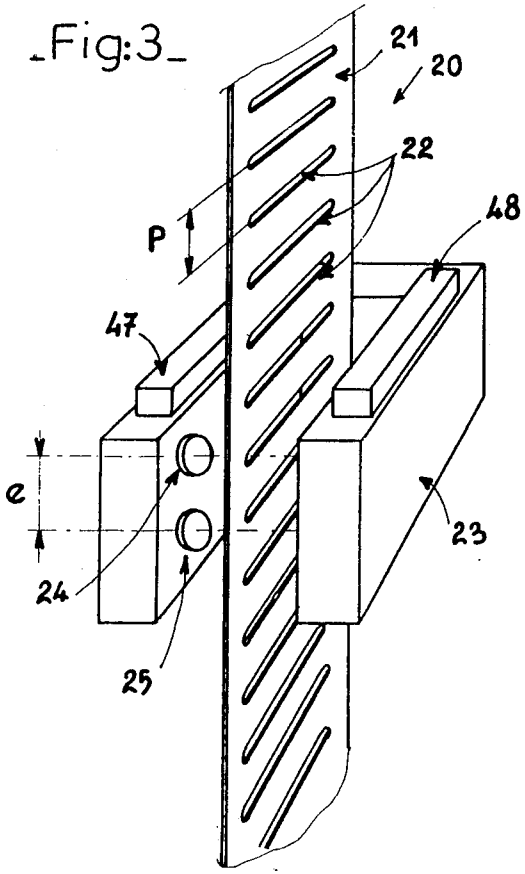

In this application to an existing installation, the invention will be better understood from the accompanying drawings which show schematically:

FIG. 1: is a view of an elevator installation,

FIG. 2: is a view of the electric power supply circuit for the electric motor,

FIG. 3: is an illustration of the coded means and its reader,

FIG. 4: is a schematical view illustrating the processing of the signal picked up by the reader of the coded means, FIG. 5: is a curve illustrating the regulation command for setting the cabin of the elevator in movement, FIG. 6: is a curve illustrating the regulation command for slowing down the elevator cabin, and FIG. 7: is a curve illustrating the final slowing down phase.

In FIG. 1 there has been shown schematically an elevator installation 1 which, in a way known per se, comprises a cabin 2, a counterweight 3 and an electric motor 4 driving a cable 6.

The cabin 2 moves inside a shaft 5, along appropriate guide means, this shaft defining its predetermined path.

The cabin further serves levels which have been shown schematically by way of illustration from 7 to 10.

For an already existing installation, the invention applies for three phase electric drive motors comprising one or two speeds, and in this latter case, only the windings corresponding to one of the speeds will be used.

The electric control installation comprises mainly operating means shown schematically at 11 in FIG. 2.

These means receive information concerning the safety of the installation, for example, from lock contacts which are shown schematically at 12, as well as other information relative to the safety of the installation which has not been shown.

The operating means 11 also receive orders for movement, coming more particularly from buttons for calling the cabin at the different levels schematized at 13 and destination buttons in the cabin shown schematically at 14.

Finally, the operating means receive information about the position of cabin 2 inside shaft 5 which is generally delivered by contactors shown schematically at 15 disposed inside the shaft.

These contactors are generally situated not only at the height of the different levels but also on each side levels at the entrance to the slowing down zones.

The operating means 11 process the whole of this information generally in a combinative way and determine, on the one hand, the moving strategy of the cabin 2 and, on the other, the associated orders such as opening of the doors.

The operating means 11 drive means 16 for actuating the motor which are generally formed by contactors capable of connecting the different phases of the network to the terminals of the windings of the electric motor 4.

Depending on the operating strategy defined by the operating means, the orders transmitted to the actuating means are orders for going up or going down, accelerating, for passing at high speed, if necessary at low speed, as well as braking orders.

FIG. 2 shows schematically a connection 18 between the operating means 11 and the actuating means 16 by which the orders transit and a connection 17 through which transits the information relative to safety.

The electric installation of the control motor 4 also comprises a control, not shown, of the application or lifting of the brake.

The invention proposes replacing the direct connection 18 by regulated control means 19 which, in response to the orders for going up, going down, setting in movement, braking coming from the operating means 11, send to the actuating means 16 a regulated voltage order ensuring the optimum comfort of the users.

In accordance with the invention, along the predetermined path of the moving body there is disposed, i.e. inside the shaft 5 of the elevator, a means 20 coded by evenly spaced marks.

Such a means is shown by way of illustration in FIG. 3 in the form of a strip 21, pierced at regular intervals by oblong perforations with horizontal axis 22.

The marks 22 of the coded strip 21 are read by a reader 23 fixed to the cabin 2.

FIG. 3 shows by way of illustration the reader 23 in the form of a stirrup whose two arms extend on each side of strip 21.

The arms of the stirrup 23 are equipped with optical readers which, in a way known per se, deliver pulses whenever they meet perforations 22 of strip 21.

Advantageously, the stirrup 23 is equipped with two optical reader assemblies 24, 25 whose spacing apart "e" measured in the direction defined by strip 21 is equal to a quarter of the pitch "e" between two successive perforations 22, within a whole number of pitches "p".

This arrangement advantageously multiplies by four the accuracy of the distances measured along strip 21 and allows information to be obtained concerning the direction of movement of reader 23 along strip 21, from logic processing of the signals transmitted by the reader assemblies 24, 25.

By way of non limitative example, good results have been obtained using a metal strip 21 made from an aluminimum alloy 60 mm in width, having perforations 22 35 mm in width, and 3 mm in height whose spacing pitch is 8 mm.

This is of course given solely by way of illustration.

The coded means 20 is positioned by any appropriate means in the shaft 5 of the installation, to which it is fixed.

For determining the position of the cabin, on the coded means 20 at least one reference mark 26 is defined which corresponds preferably to a reference position of cabin 2 shown schematically at 27 which is for example the position of cabin 2 at its lowest level.

During movement of the cabin 2, the passage of the optical reader assemblies 24, 25 in front of the successive perforations 22 of the coded strip 21 cause pulses which are transmitted to the regulated control means 19.

Referring to FIG. 4, these pulses are first of all shaped by means 28 which determine the number of marks met and the direction of movement of the cabin.

Then, by upcounting/downcounting the marks met from the reference mark 26, the means 29 determine the position index IP of the cabin, i.e.the number of marks situated between reader 23 on the cabin and the reference mark 26 of the strip.

The speed of the cabin is determined by means 30 from counting up the marks met by reader 23 and so from the variations of the position index IP.

Considering the method adopted for knowing the absolute position of the cabin, the position index and the speed of the cabin are known from means 29 and 30 in a sequential manner which, it should be emphasized, is particularly well adapted to the digital treatment which is carried out downstream.

Since the reader itself determines the direction of movement, it increments the counter directly and automatically in the suitable direction, which avoids any error which, during stopping of the cabin, is due to counting non directed pulses due to jolting during loading and unloading of the cabin.

The digital processing unit 31 of the regulated control means 19 situated downstream of means 29, 30 is of any appropriate type and preferably comprises a microprocessor as well as its usual environment.

This unit also comprises memory tables which are for example of the safeguarded RAM type or of the erasable ROM type.

These tables are for example accessible by means of an access terminal 32 and are as a rule programmed once and for all during setting up of the installation.

Among these tables, the level index table 33 contains the level indexes IN that is to say the different numbers of marks situated between the marks associated with the different levels 7 to 10 of the installation and the reference mark 26.

Similarly, the slowing down index table 34 contains the slowing down indexes IR which are associated with the different level indexes IN and which define on the coded means 20 the slowing down zones for reaching a given level.

More exactly, in the case of an already existing installation, these slowing down indexes correspond substantially to the old contactors situated in the shaft which were situated at the entrance to a slowing down zone for reaching a defined level. In fact, in the case of an already existing installation, when the position index IP reaches the value of one of the slowing down indexes IR, a signal AN 35 is sent by the regulated control means 19 to the operating means 11 and these, in return, send a slowing down order if the cabin is to stop at the level associated with the slowing down index.

At the level of the regulated control means 10, this slowing down order is in fact only interpreted as a validation of the slowing down and it is the central processing unit 31 which determines the mark from which the slowing down control will be effectively applied to the electric motor 4.

Thus, the level index 33 and slowing down index 34 tables mean that the contactors 15 in the shaft are no longer required and the regulated control means 19 generates signals which, seen by the operating means 11, are similar to the signals emitted by the prior contactors 15.

In some cases, however, the contactors 15 may be kept.

The central processing unit 31 also contains other parameter tables in its memory, and in particular a table 36 containing the parameters for setting cabin 2 in movement, a table 36 containing parameters for slowing down the cabin as well as a table 38 containing the initialization parameters.

The central processing unit 31 comprises processing means, such as a microprocessor, and storage means for the processing software.

At the output, the central processing unit controls the actuators 16 which determine the direction of rotation of the motor and connect the windings of motor 4 to the different phases of the network through a power stage 39 also controlled by the central processing unit and, for example, formed by thyristor assemblies or any other appropriate electronic means, which allow the energy delivered from the network to the electric motor 4 to be proportioned.

Thus, in the case of an already existing installation, the regulated control means 19 are disposed between the operating means 11 and the actuating means 16 of the motor.

The regulated control means 19 receive from the operating means 11 the orders for upward and downward movement as well as the slowing down orders.

Taking these orders and the information received from reader 23 of the coding means 20 into account, the regulated control means 19 generate an order which is exerted on actuator 16 of the motor and on the thyristor stage 39.

This order is preferably of the graduator type, that is to say that it consists in controlling the time during which each thyristor is conducting for each mains half wave.

The graduator type control of the thyrsitors may however by replaced by a more complex control.

Besides the regulated control means 19, the regulated control device preferably comprises an interface 40 for the operating means 11 and an output interface 41 for the actuating means 16.

Depending on the case, the distinction between the central processing unit 31, the means 29 for determining the absolute position of the cabin and the means 30 for determining its speed, may be less marked than what has been shown in FIG. 4 and in the above description for the sake of comprehension of the invention.

In fact, counting of the pulses and calculation of the speed of the cabin may provided by the miroprocessor of the central processing unit 31, that is to say that the means 28, 29, 30, 31 may be confined together for example on the same electronic card, under the same overall processing software.

It should be mentioned that, contrary to some installations which use a coded strip for determining the position of the cabin by direct reading, in the present case the absolute position of the cabin is obtained by upcounting/downcounting.

With respect to existing devices using a coded strip, the invention has the advantage that the code of strip 21, i.e. the perforations 22 is particularly simple with respect to the codes which allow the absolute position of the cabin to be obtained directly.

These latter codes in fact require complex decoding of a large amount of information for example in the form of perforations which are disposed either horizontally on the coded strip or else vertically.

To know the speed of the moving body, it is necessary to process this complex information or to provide a device such as an independent tachometric generator.

Compared with devices comprising a coded disk mounted on the drive shaft, the invention has the advantage of greater accuracy in determining the position of the cabin, since there is no need to take into account the slipping of the cables.

For initializing the regulated control means, in particular the position index IP, or for reinitializing more particularly after a power cut, the invention provides at least one and preferably two initialization marks 42, 43 on the coded means 20.

These marks 42, 43 determine three zones on the coded means 20, a low zone 44, a high zone 46 and an intermediate zone 43.

Apart from the optical reading assemblies 24, 25 the reader 23 also comprises contactors 47, 48 which are responsive to the marks 42, 43.

For example, marks 42, 43 are formed by ferrites oriented in opposite directions and contactors 47, 48 are magnetic contactors with mechanical memory also oriented in opposite directions.

Thus, whatever the circumstances may be, the position of the cabin in one of the three zones 44, 45, 46 is permanently known through the contactor means 47 and 48.

After a power cut and so the loss of the position index 29, if cabin 2 is in the intermediate zone 45, the regulated control means 19 will react to an order for going up or for going down which they will execute, whatever the level selected, until the reader 23 of cabin 2 meets one of the two initialization marks 42, 43.

This causes in the regulated control means 19 the reinitialization of the position index 29 and then causes the cabin to stop at the immediately lower or upper station depending on the case then possibly movement of the cabin to the selected station.

The regulated control means 19 will only order cabin 2 to move upwards if it is in the low zone 44 in which case initialization thereof will take place on meeting the top mark 43 or else conversely for downward movement if the cabin is in the top zone 46 with initialization at the low mark 42.

The regulated control device of the invention is therefore particularly advantageous for equipping existing installations, since it is independent and does not require the placing of optional means as a function of the already existing installation.

For new installations, of course, positioning of the device of the invention raises no problem.

FIG. 5 illustrates starting up of cabin 2 from a station at which it is stopped to a selected station.

For such starting up, the operating means 11 deliver an order for lifting the brake and an order for moving in a given direction for example for going up, which positions the actuator 16 so that the motor is supplied with power for rotating in the desired direction.

Control of the thyristors of the power stage 39 is initially substantially zero and so the thyristors are substantially closed.

The regulated control means 19 deliver to the thyristor gates an incremented control, in an open loop, and the incrementation is provided in two principle different ways.

In a first way corresponding to a drive torque exerted by cabin 2 on motor 4, the control of thyristors 39 is incremented in time by a low increment $i_f$. Thus, it is the driving torque of the cabin which acts principally, in the first phase of setting the cabin in movement, resulting in a great impression of comfort for the users.

Then, taking into account the incrementation, the effect of the motor becomes predominant and the cabin accelerates until it reaches a speed close to the nominal moving speed $V_N$ corresponding to complete opening of the thyristors.

For this, the speed variations are shown in FIG. 5, by curve 50, which has an "S" shape whose beginning is substantially linear and which is substantially stabilized above the value $V_N$.

This method of regulated control of the electric motor 14 is adopted by the regulated control means 19 for a drive torque exerted by the cabin/counterweight assembly on the motor that is to say more particularly for upward movement empty and downward movement with full load.

In the opposite case, for a resistant torque, that is to say in the case of downward movement when empty or upward movement with full load, control of the thyristor which is initially substantially zero is also incremented with a low increment $i_f$.

The resistant torque exerted by the cabin drives the cabin in the opposite direction to the desired direction, which is immediately detected at the level of the position index $I_p$ which varies irrationally.

Such irrational variation detected by the central processing unit 31 causes the control increment of thyristors 39 to be increased which passes to a high increment value $i_F$.

Curve 51 shows the variation of the square of the speed of the moving body for this starting up mode.

Curve 51 has an initial part 52 situated below the horizontal axis, then it has an "S" shape which is stabilized in the vicinity of the nominal speed $V_N$.

It should be emphasized that the reverse movement of the cabin on start up is quite limited.

In fact, in the case where the spacing pitch "p" of the perforations is 8 mm, the reverse movement of the cabin is detected with the first pulse transmitted by the optical readers 24, 25, after travelling a distance equal to a quarter of this pitch, i.e. after a distance of the order of 2 mm only.

These two methods of setting the moving body in movement by small or high incrementation , depending on whether the torque exerted by the cabin on the motor in driving or resisting, provides optimum comfort for the users.

FIGS. 6 and 7 are relative to slowing down of the moving body, with a view to stopping it at a level N with which the index level $I_N$, as well as a slowing down index $I_R$ are associated, which are respectively stored in tables 33 and 34.

During movement of cabin 2, when the position index $I_p$ reaches the value $I_R$ of the slowing down index, the central processing unit 31 addresses to the operating means 11 information AN 35 indicating the approach of level N.

Since, in the present case, level N is selected, the operating means 11 sends to the regulated control means 19 a slowing down order for stabilizing the cabin at level N.

At the level of the central processing unit 31, the slowing down orders are generated with reference to a reference speed as a function of the difference between the position index $I_p$ of the cabin and the level index $I_N$.

The speed reference 54 shown in FIG. 6 is formed by an oblique curve which is linear and extends over an interval $Z_R$ corresponding to the slowing down zone of the cabin.

Taking into account the direction of movement of the cabin, this slowing down zone $Z_R$ is limited by an index $I_{ZR}$ from which the regulated control means are capable of generating a slowing down order, and on the other side the zone is limited by the index $I_N$ of the level.

Generally, the index $I_{ZR}$ is situated after the slowing down index $I_R$ which validated the slowing down order.

This corresponds to a reduction of the slowing down travel of cabin 2 which the regulated control means provide.

The oblique curve 54 in the slowing down zone $Z_R$ decreases from the nominal speed $V_N$ to a zero speed.

It corresponds to constant deceleration which, by way of example, may be of the order of 0.50 m/s$^2$.

According to the invention, the regulated control means generate a slowing down order inside the slowing down zone $Z_R$ only when, for a given position index, the speed of the moving body is equal to or greater than the reference speed.

Referring to FIG. 6, curve 5- correspnds to a moving speed of the moving body substantially greater than the speed $V_N$.

In this case, the slowing down order generated by means 19 is applied as soon as the position index $I_P$ has reached the value $I_{ZR}$, that is to say from point 57.

On the other hand, curve 58 which corresponds to a speed substantially less than the speed $V_N$, the order for slowing down the motor is only generated from the position index $I_p$ for which the speed of the moving body corresponds to the reference speed, i.e. point 59.

Advantageously, in the case where the moving body is still in the starting up phase when the slowing down order arrives, particularly for a short travel distance, the order for accelerating the motor is maintained until the speed of the moving body intersects the reference speed curve.

This is shown schematically in FIG. 6 by the dot dash line curve 60 and the acceleration order is maintained as far as point 61 intersecting with the reference curve.

In a first phase of slowing down of cabin 2, the regulated control means 19 close the thyristors 39 and order a phase inversion at the level of actuator 16.

Then, the means continuously generate a variable control on the thyristors which depends mainly on the difference between the position index $I_p$ and the level index $I_N$, and on the difference between the speed of the moving body and the reference speed.

Preferably, the reference also depends on the speed variation of the moving body.

At the level of thyristors 39 feeding motor 4, the slowing down control consists of a variation of their opening as a function of the position index $I_p$ and the speed of the cabin.

It should be emphasized that slowing down is solely electric, using phase inversion which is maintained until the cabin stops.

The slowing down order generated by the regulated control means 19 tends to reduce the difference between the speed of the moving body and the reference speed which becomes small at the end of slowing down as shown in FIG. 6.

In FIG. 7, the final phase of slowing down the moving body has been shown schematically.

This Figure shows that the reference curve 54 is not exactly directed towards index $I_N$ on the horizontal axis of the indexes but an index situated substantially before index $I_N$ taking into account the direction of movement of the moving body.

When the position index $I_p$ reaches a value $I_{RF}$ defining a given final slowing down zone $Z_{RF}$, the regulated control means 19 calculate, as a function of the real speed of the moving body, the theoretical time $T_{RF}$ required for the speed of the moving body to be cancelled out.

Control of the thyristors which was applied when passing index $I_{RF}$ is maintained at the beginning of the zone $Z_{RF}$ and for a final predetermined lapse of time, the regulated control means generate on the thyristors a control for temporary stabilization of the rotor.

For example, this control consists in desynchronizing the control of the thyristors with respect to the frequency of the mainly so as to feed a DC current into the windings of the motor.

The final lapse of time during which this stabilization control is generated is constant and, taking into account the possible difference between the speed of the moving body and the reference speed during the final slowing down phase, it corresponds approximately to a third of the time interval $T_{RF}$.

FIG. 7 shows by way of illustration two curves 62 and 63, situated on each side of the reference curve 54.

The lower rounded ends of curves 62 and 63 correspond to the stabilization control of the rotor.

When the speed of the moving body has been cancelled out, the central processing unit generates the brake application order 64.

Then, in a known way, the operating means 11 control opening of the doors.

Such a regulated slowing down control allows level N to be reached with an accuracy which, in the above example, is less than plus or minus 2 mm only, without any jolting mainly in the final braking phase.

It further allows the slowing down time to be optimized because of the speed/index difference reference.

The method and the regulated control device which have just been described find an advantageous application within the field of renovation of existing installations. In this case, the device is independent and as was mentioned above it can be readily integrated into the existing installation.

More particularly, the means 19 may be in the form of an electronic card, contained inside a case which may be readily fitted in the existing installation.

This is of course not limitative and the method and device of the invention may also be used for new installations and, in this case, the operating means 11, regulated control means 19 and the actuating means 16 may be combined in the same assembly.

Finally, the invention relates not only to elevator installations but also to goods lift, handling and storage installations.

Of course, the present description has only been given by way of illustration and other embodiments of the invention could be adopted without for all that departing from the scope and spirit of the invention.

I claim:

1. A method for the regulated control of an electric motor (4) for moving a body (2) along a given path (5) comprising stopping levels (7 to 10) and zones of movement between the levels, more particularly, but not exclusively, a goods lift, an elevator, the carriage of a storage or handling installation, along the path of which is disposed a coded means (20) comprising evenly spaced marks (22) which are detected by a reader (23) and are taken into account for deducing the speed of the moving body, this process being characterized by the steps of:

defining at least one reference position (27) of the body (2) along the coded means (20) and the reference position having an associated reference mark (26) of the coded means (20);

associating a number of marks counted from the reference mark (26) with each stopping level (7 to 10), which number is called the level index ($I_N$);

defining, for each stopping level, an interval of marks ($I_{ZR}$) from the corresponding level index ($I_N$) and corresponding to a slowing down zone ($Z_R$) of the body for reaching a stopping level;

during movement of the body (2), counting algebraically the number of marks met by the reader (23) fixed to the body;

calculating a position index ($I_p$) of the body with respect to the reference mark (26) by upcounting-/downcounting the marks;

defining, within each interval of marks ($I_{ZR}$) corresponding to a slowing down zone ($Z_R$) and for stopping the body at a given level, a speed/deviation reference between the position index ($I_p$) and level index ($I_N$);

continuous control braking of the motor for stopping the body at a given level according to a slowing down reference (54) only from the marks of the slowing down zone ($Z_R$) for which the speed of the moving body is at least equal to the speed/deviation reference;

defining two endmost slowing down zones (44, 46) and an intermediate zone (45) by means of two marks for initialization of the coded means along the path of the body;

constantly memorizing the position of the body in one of the two endmost slowing down zones (44, 46) or intermediate zone (45); and reinitializing the position index ($I_p$) according to one of the initialization marks (42, 43).

2. A device for the regulated control of a moving body comprising: a coded means (20) disposed along the path of the moving body and having evenly spaced marks (22) on coded strip (21) which are detected by a reader (23) and are taken into account for deducing the moving speed thereof, this device being characterized by the fact that it comprises in combination:

on the coded means (20) at least one reference mark (26) corresponding to a reference position (27) of the moving body (2), a reader (23) fixed to the moving body for reading the marks (22) of a coded means (20), means for algebraically counting the number of marks met by the reader (23) during movement of the moving body (2) and by upcounting/downcounting the marks, means (29) for calculating the position index ($I_p$) of the moving body, processing means (31) for sending to the electric motor (4) a progressive braking voltage continuous control inside an interval defined by marks ($I_{ZR}$) corresponding to a slowing down zone, said control being determined according to the difference between the position index ($I_p$) and the level index ($I_n$) and the difference between the speed of the moving body and a reference speed for the position index ($I_p$), and characterized by the fact that it comprises on the coded strip 21 at least two initialization marks (42, 43) which define two endmost slowing down zones (44, 46) and an intermediate zone (45) and permanent memorization means (47, 48) for storing the position of the moving body in one of the three zones (44, 45, 46).

3. A method in accordance with claim 1, characterized in that a reference speed function (54) is determined in such a manner that it tends to apply braking until the moving body has a speed which is essentially zero at its arrival at a point slightly ahead of the level mark taking into account the direction of movement.

4. A method in accordance with claim 1, characterized in that in order to move the moving body (2) from a defined level to a selected level, the mechanical brake (64) is released, then an initially substantial zero voltage order is sent to the motor, then incremented in time by a low increment ($i_f$) corresponding to the increment required when a driving torque is applied to the motor (4) by the moving body.

the change in the position index ($I_p$) is observed and, if this change corresponds to a reverse movement to the one selected, the incremental value of the voltage control is increased so that an order is sent to the motor corresponding to the increment required when a resistant torque is applied to the motor (4) by the moving body (2).

5. A device for the regulated control of a moving body (2) moved along a given path by a motor (4), comprising a memory storing indices of stopping levels, a coded means (20) carrying marks (22) spaced at regular intervals along the path and, by means of a reader (23) associated with the moving body, the position of the moving body is detected and computed for its determination, said device being characterized by the coded means being disposed along the path of the moving body (2) and the reader being a double reader for the purpose of determining the direction of movement and, said device further comprises in combination:

in the coded means (20) itself at least one reference mark (26) corresponding to a reference position (27) of the moving body (2), means which, together with the double reader, add or substract and then count algebraically the number of marks encountered by the reader (23) in the course of the movement of the moving body (2) past the reference mark and then calculate the real instantaneous speed of the moving body, calculating means (29) for a position index ($I_p$) of the moving body for the upcounting/downcounting of the marks after the reference mark (26).

6. A device in accordance with claim 5, characterized in that it further comprises:

processing means (31) for sending to the electric motor (4), when the moving body is inside an interval defined by the marks ($I_{ZR}$) corresponding to a slowing down zone ($Z_R$), a progressive braking reference speed function (54) determined in accordance with:

the difference between the position index ($I_p$) of the motor and a level index ($I_N$) and the difference between the speed of the moving body and the reference speed function (54) corresponding to the current value of the position index ($I_p$).

7. A device in accordance with claim 5, characterized in that it further comprises:

means (36) for sending to the electric motor (4) a voltage order for initially substantially zero movement then incremented in time by a low increment ($i_f$) corresponding to the increment required when a driving torque is applied to the motor (4) by the moving body (2), means (28) to analyze the first variation of the position index, and means which, if the change in the position index ($i_p$) varies in the direction opposite the proper direction, increases the incremental value to a large incremental value ($i_F$) corresponding to the increment required when the torque is resistant.

8. A device in accordance with claim 5, characterized in that it comprises:

on the coded means (20) at least two initialization marks (42, 43) which define two outer zones (44, 46) and an intermediate zone (45) and on the moving body (2) permanent memorization means (47, 48) for storing the position of the moving body in one of three zones (44, 45, 46).

9. A device in accordance with claim 5, characterized in that it comprises an input interface (40) for the starting-up orders and the slowing-down orders coming from operating means (11) of an existing installation and an output interface (41) towards the means (16) for actuating the motor (4) of said installation.

* * * * *